United States Patent [19]

Malbec

[11] Patent Number: 5,044,902

[45] Date of Patent: Sep. 3, 1991

[54] CARTRIDGE FOR PERISTALTIC PUMP WITH A FLEXIBLE TUBE, AND PERISTALTIC PUMP FITTED WITH SUCH A CARTRIDGE

[76] Inventor: Edouard Malbec, Logis de Chalonne, 16160 Le Gond Pontouvre, France

[21] Appl. No.: 491,705

[22] Filed: Mar. 12, 1990

[30] Foreign Application Priority Data

Mar. 13, 1989 [FR] France ..... 89 03234

[51] Int. Cl.[5] ..... F04B 43/08

[52] U.S. Cl. ..... 417/477; 604/153

[58] Field of Search ..... 417/475, 476, 477; 604/153

[56] References Cited

U.S. PATENT DOCUMENTS

| | | | |
|---|---|---|---|
| 3,249,059 | 3/1966 | Renn | 417/477 |
| 3,366,071 | 1/1968 | Dutler | 417/477 |
| 4,205,948 | 6/1980 | Jones | 417/477 |
| 4,211,519 | 7/1980 | Hogan | 417/477 X |
| 4,417,856 | 11/1983 | Minnissina | 417/477 |
| 4,573,887 | 3/1986 | Smith | 417/477 |
| 4,909,713 | 3/1990 | Finsterwald et al. | 417/477 |
| 4,950,136 | 8/1990 | Haas et al. | 417/477 |

FOREIGN PATENT DOCUMENTS

| | | | |
|---|---|---|---|
| 1528964 | 6/1969 | Fed. Rep. of Germany . | |
| 2409103 | 9/1975 | Fed. Rep. of Germany | 417/477 |
| 2383333 | 10/1978 | France . | |
| 2417025 | 9/1979 | France . | |
| 2595765 | 9/1987 | France | 417/477 |
| 2599434 | 12/1987 | France . | |
| 55-151289 | 11/1981 | Japan | 417/477 |
| 1186961 | 4/1970 | United Kingdom . | |

*Primary Examiner*—Louis J. Casaregola
*Assistant Examiner*—Timothy S. Thorpe
*Attorney, Agent, or Firm*—Cushman, Darby & Cushman

[57] ABSTRACT

The cartridge (7) is comprised of a housing (8) which comprises, in the vicinity of each of its ends, a cylindrical raceway (16, 17) against which are capable of applying and rolling bevel gears (9) which crush the flexible tube (2) located between both raceways. The bevel gears (9) are tubular and freely mounted inside the housing (8), within the concavity of the flexible tube, this housing comprising, at least on one side, a central opening (13) with a diameter large enough to enable the driving of the bevel gears either directly from a rotary disc (5) provided with planet gears (22) capable of engaging into the tubular bevel gears or from a shaft internally engaged between the tubular bevel gears.

9 Claims, 3 Drawing Sheets

CARTRIDGE FOR PERISTALTIC PUMP WITH A FLEXIBLE TUBE, AND PERISTALTIC PUMP FITTED WITH SUCH A CARTRIDGE

The invention relates to a cartridge for a peristaltic pump with a flexible tube, comprised of a housing which comprises, in the vicinity of each of its ends, a cylindrical raceway against which are capable of applying and rolling rollers which crush the flexible tube located between both raceways.

A cartridge of this kind is disclosed, e.g., by EP-0 041 267. The arrangement of this cartridge is however rather complex and limits the possibilities of use of said cartridge.

The object of the invention is essentially to provide a cartridge of the type defined above, which is of a simple and robust construction, which allows an efficient pumping and the possibilities of use of which are increased.

According to the invention, a cartridge for a peristaltic pump with a flexible tube, of the type defined above, is characterized in that the rollers are tubular and freely mounted inside the housing, within the concavity of the flexible tube, this housing comprising, at least on one side, a central opening with a diameter large enough to enable the driving of the rollers either directly from a rotary disc provided with planet gears capable of engaging into the tubular rollers or from a shaft internally engaged between the tubular rollers.

Thus, one and the same cartridge may be driven either directly by a disc, this driving method allowing to accurately know at any time the angular position of the disc and, thus, of the rollers, or by a central shaft with the possibility of a high rotation speed. The rollers are construed in a simple and cheap way and their free mounting inside the cartridge is advantageous for the operation of the pump.

When the cartridge is separated from the driving motor, the rollers are brought back to the centre under the pressure of the tube at rest, this tube remaining open, which makes possible an easy and complete sterilization.

The housing has preferably an internal groove with a concave cross-section into which is housed the flexible tube, while the rollers are externally barrel-shaped, with a convex curvature combined with the concave curvature of the groove of the housing, to rest against the flexible tube, rollers gear comprising, on both sides of the barrel-shaped area, a cylindrical area capable of rolling on the associated raceway; such a housing with a concave internal profile allows a self-centering of the tube and the rollers.

The housing advantageously comprises a cylindrical central crown wheel onto which is fixed, on both sides, viz. by clipping or ratcheting, a flange comprising an internal raceway, the flange located on the driving-motor side comprising a substantially truncated rim allowing to assure the fixing of the housing onto a driving-motor housing by co-operation of this truncated rim with teeth, having a certain flexibility in the radial direction, provided on the whole periphery of a toothed crown wheel connected to the motor-housing.

The tubular rollers are generally made of a flexible plastic material.

The invention also relates to a peristaltic pump fitted with a cartridge such as defined above, this pump comprising a motor capable of driving the tubular rollers.

The pump motor preferably comprises an outlet shaft provided with a disc bearing spindles onto which are loosely mounted rollers capable of engaging into the tubular rollers. The disc may comprise, viz., a spindle located in the extension of the motor shaft and onto which is loosely mounted a central roller with a relatively important self-centering backlash, capable of co-operating with the external surface of the rollers.

The housing of the cartridge is generally closed, at the side opposite to the motor, by an inserted cover, whereby one of the raceways for the rollers may be provided on the internal face of the cover.

In a particular embodiment, the disc of the pump comprises four regularly spaced rollers and a central roller, whilst the cartridge comprises four rollers.

The invention consists, besides the arrangements explained above, in a number of other arrangements which will be more explicitely explained below with respect to the particular embodiments described with reference to the attached drawings, but which are in no way restrictive.

FIG. 1 of these drawings is a perspective view of a peristaltic pump according to the invention, the cartridge being separated from the disc.

Figure 9:
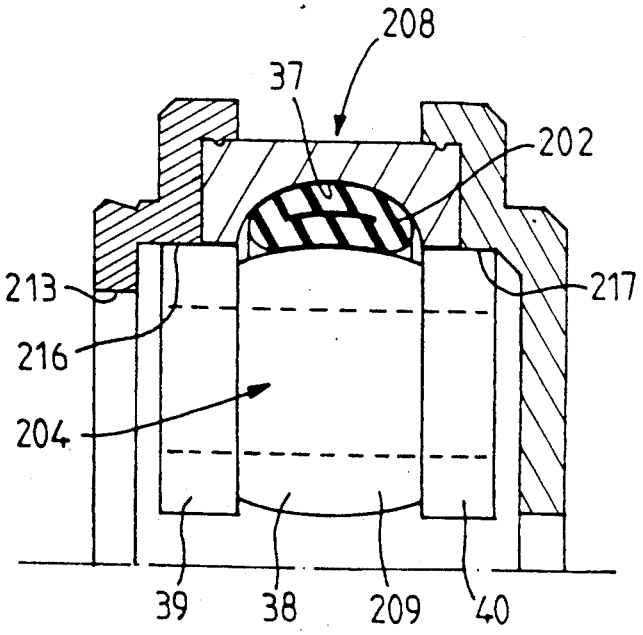

Finally, FIG. 9 is a cross-section of another advantageous embodiment of the cartridge.

With reference to the drawings, a peristaltic pump 1 can be seen, comprising a flexible tube 2, viz. of plastic material, forming the body of the pump. This tube is interposed between an external cylindrical housing 3 and internal rollers 4 capable of co-operating with a central driving element 5 which is, in turn, driven by an electric motor 6.

The pump 1 comprises a removable cartridge 7 comprised of a cylindrical housing 8 in which is mounted the tube 2, as well as tubular rollers 9, four in number in the embodiment considered.

These rollers 9 form the internal rollers 4 and are advantageously made of a flexible plastic material. The rollers 9 may be formed by pieces of extruded tube of plastic material.

The tube 2 substantially describes a semi-circle inside the housing 8 and extends outside this housing through openings 10 in substantially parallel legs 11.

Figure 1:
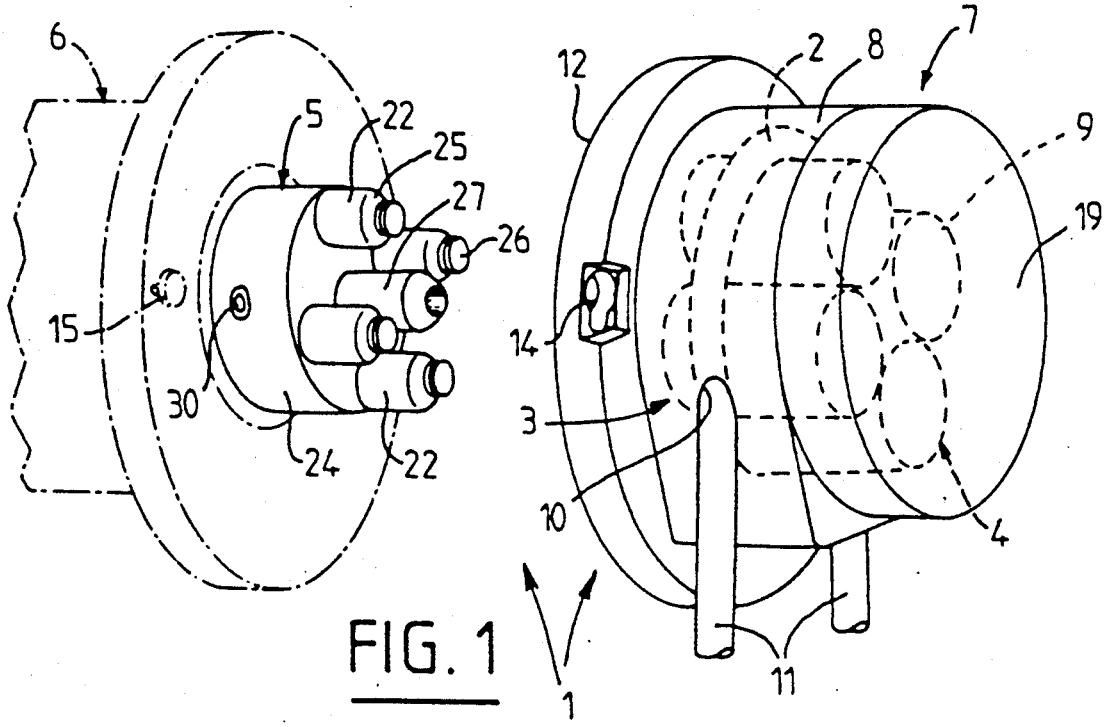
Figure 2:
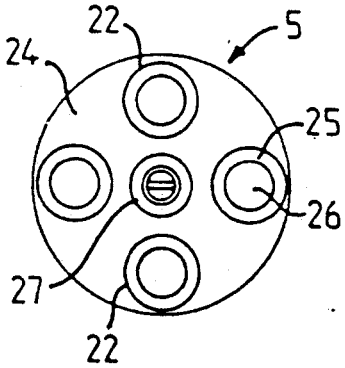
FIG. 2 is a view of the disc along the line II—II of FIG. 5.
Figure 3:
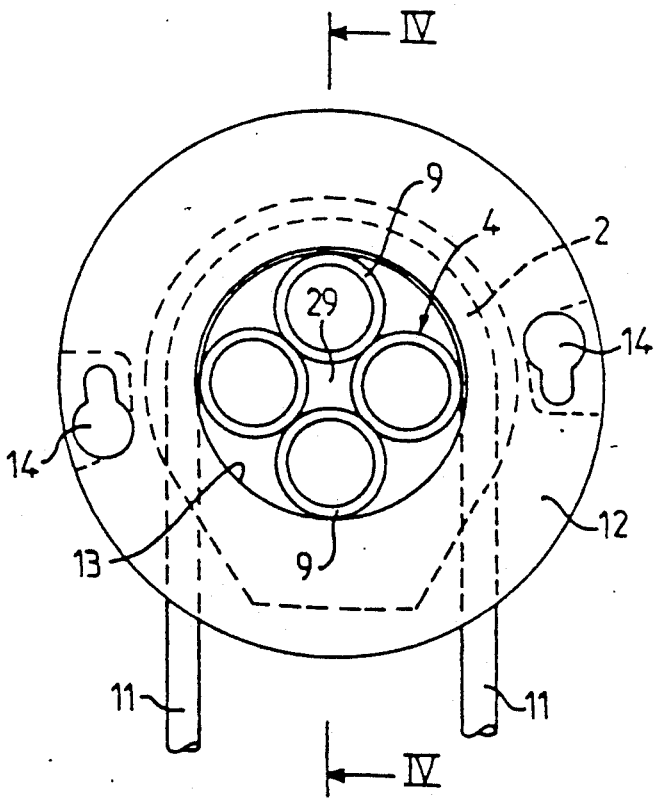
FIG. 3 is a view of the cartridge along the line III—III of FIG. 4.
Figure 4:
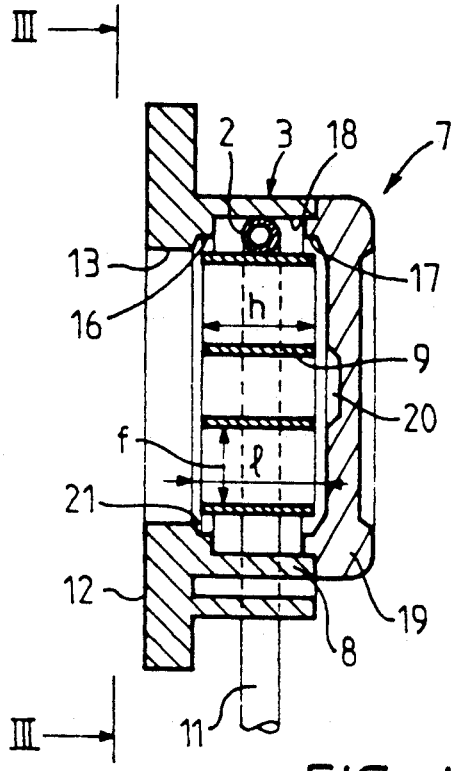
FIG. 4 is a cross-section of the cartridge along the line IV—IV of FIG. 3.

When the cartridge is removed, as shown in the FIGS. 1, 3 and 4, the rollers 9 are free inside the housing and the tube 2 is practically uncompressed.

The face 12 of the housing intended to be applied against the motor 6 comprises a central opening 13 with a diameter large enough to allow the driving of the rollers 9 as explained below. This face 12 has a larger diameter than that of the housing 8 and forms a flange radially projecting with respect to the housing, in which flange are provided two diametrically opposed buttonholes 14 to enable the fixing of the cartridge 7 onto the motor 6 provided with pawns 15 with heads capable of co-operating with the buttonholes 14.

The housing 8 of the cartridge comprises, in the vicinity of each of its ends, in the axial direction, a cylindrical raceway 16, 17 (see FIG. 4) against which are capable of applying, and rolling, the tubular rollers 9, the flexible tube 2 being located between both raceways, against a cylindrical surface 18 the diameter of which is larger than that of the raceways 16, 17.

The housing 8 is closed, on the side opposite to the driving motor of the pump, by an inserted cover 19 on which is provided the raceway 17 which forms the internal surface of a centering collar of the cover 19 in the housing. The internal face of this cover 19 comprises a central recess 20.

The rollers 9 are maintained, in the longitudinal direction, between the internal face of the cover 19 and a shoulder 21 (FIG. 4) along the opening 13 on the inner side of the housing.

The distance 1, in the axial direction, between this shoulder 21 and the internal face of the cover 19 is only slightly larger than the axial length h of the rollers 9, in order to assure a good maintaining of these rollers and to avoid any slanting. The difference l−h is preferably smaller than or equal to 0.2 mm.

Rollers 22, loosely mounted onto spindles 23 borne by a disc 24, are capable of engaging into the rollers 9, passing through the opening 13. The rollers 22 are evenly distributed around the axis of the disc 24. The number of these rollers is equal to that of the rollers 9, i.e. equal to four in the example considered.

The end 25 of each roller 22 aparted from the disc 24 has a substantially truncated shape, in order to make easy the engagement of the roller into the corresponding rollers 9. The end of the spindle 23 is provided with a head 26 capable of maintaining the roller 22 in the longitudinal direction.

The diameter d of the rollers 22 is slightly smaller than the internal diameter f (FIG. 4) of the bevel gears 9. The backlash, i.e. the difference f−d, is advantageously in the range of 0.3 mm.

A central roller 27 is freely rotatingly mounted onto a spindle 28 which is located in the extension of the motor shaft 6 when the disc 24 is fixed onto this motor shaft.

Figure 6:
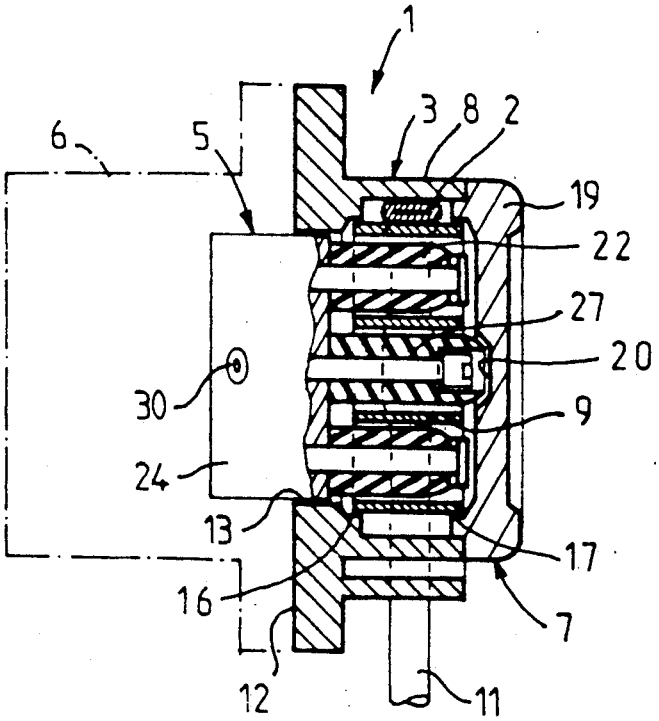
FIG. 6 is a longitudinal cross-section, with parts outside, of the pump, the disc being mounted inside the cartridge.

This central roller 27 also comprises a truncated end which is housed into the recess 20 (see FIG. 6). The head of the spindle 28 is completely housed inside a bore provided at the end of this roller 27.

Figure 5:
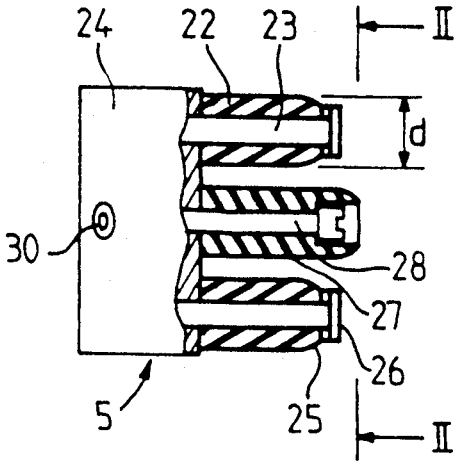
FIG. 5 is a left-hand view of the extracted parts of the disc shown in FIG. 2.

As can be seen in FIG. 5, the length of the roller 27 is larger than that of the rollers 22. Thus, when this unit is engaged into the opening 13 of the cartridge 7, the end of the roller 27 penetrates first into the space 29 (see FIG. 3) between the rollers 9 and causes these bevel gears to part, which makes easy the engagement of the rollers 22 into said rollers.

The roller 27 is mounted onto its spindle 28 with a relatively important radial self-centering backlash (difference between the diameter of the internal bore of the roller 27 and the outer diameter of the spindle 28), viz. in the range of 0.5 mm.

This roller, viz. thanks to the important self-centering backlash, provides a dynamical balance of all the pressures.

The fixing of the disc 24 onto the outlet shaft of the motor can be assured by any means, viz. by radially oriented locking screws such as 30 (FIG. 1).

When the cartridge 7 is stored separately from the motor 6 and the rollers 22 and 27, the rollers 9 are brought back to the centre under the pressure of the tube 2 at rest, as can be seen in FIG. 3, this tube remaining open until stabilization of the rollers in a tangential position of reciprocal support. This allows to avoid a sticking between the walls of the tube during storage, sticking which could occur if the tube were stored in crushed condition.

The tube 2 can be kept in position by two welded stop rings foreseen for being clamped into accurate recesses under the pressure of a supporting collar integral with the cover of the cartridge.

When manufactured in series, this tube 2 is mounted very quickly into the cartridge.

This being said, the operation of the pump is as follows.

The cartridge 7 having been placed on the disc 5, the rollers 22 are located inside the tubular rollers 9, which arest against the central roller 27. The cartridge is ratcheted onto the motor-frame by a slight rotation which, upon engagement of the catches 15 into the large-diameter part of the buttonhole 14, places said catches into the narrower part of this buttonhole which the head of the catches 15 cannot pass through.

The driving rollers 22 come to be housed, with a slight backlash, inside the tubular bevel gears 9, while the central support roller 27 exerts its pressure against the outside of the rollers 9 which go apart until the closing tightness of the pump body tube 2 on itself. This assembling can be carried out in a few seconds, with one hand.

The pumping action is obtained when the motor 6 is started to rotate, driving the disc 5 and the rollers 9.

The rollers 22, driven by the disc 5, do not directly engage the pump body tube 2, which avoids stretching of the pump body towards the delivery opening and the tendency to close the suction opening. This results into a relatively regular pump delivery curve according to the rotation speed. The free central roller 27 provides a support and a dynamical balance of all the operation pressures.

By a judicious selection of the wall thickness of the rollers 9, the outlet pressures of the pumped fluids can be influenced.

Figure 7:
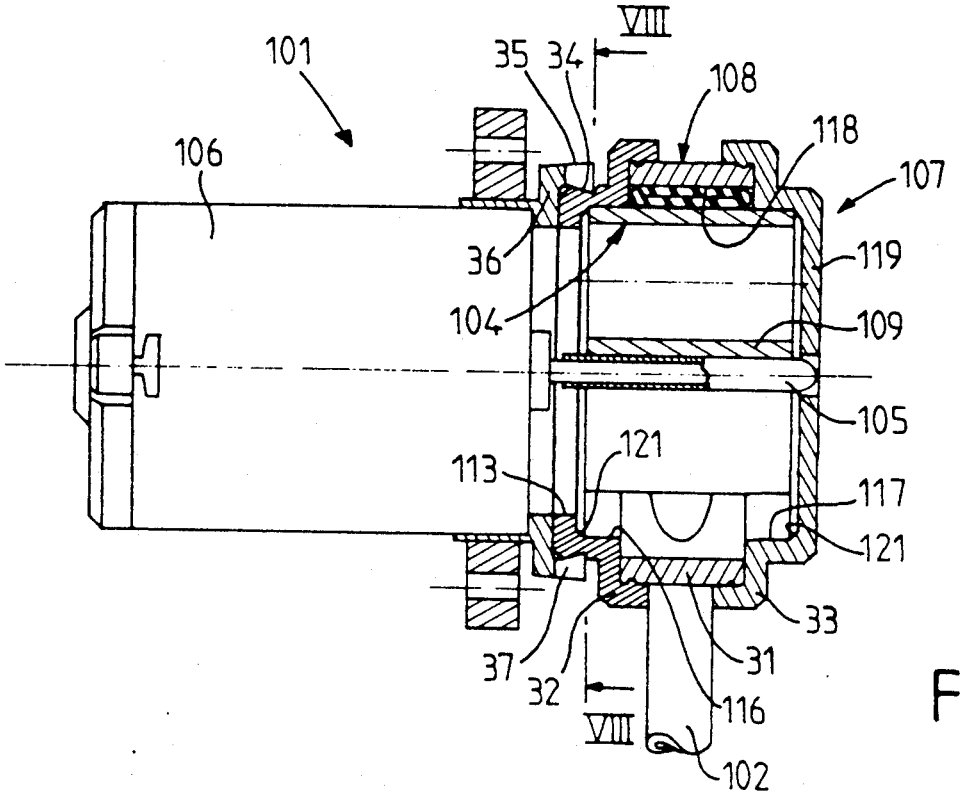
FIG. 7 is a cross-section of another embodiment of a pump according to the invention, the cartridge being shown in cross-section.
Figure 8:
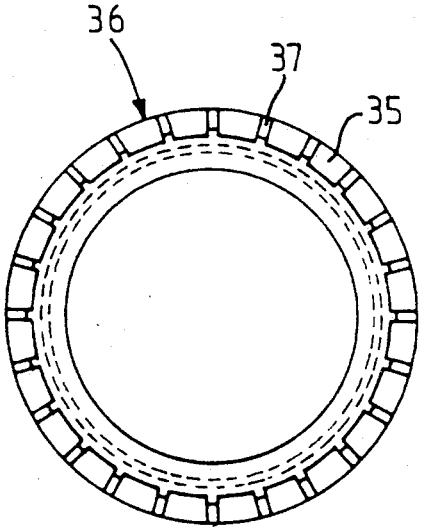
FIG. 8 is a view according to line VIII—VIII of FIG. 7 of the toothed crown wheel serving as cartridge holder.

With reference to FIGS. 7 and 8, an alternative embodiment of a cartridge and pump according to the invention can be seen. The elements of FIGS. 7 and 8 the role of which is identical or similar to that of the elements already described in connection with the preceding figures are designated by reference numbers equal to the sum of 100 and the reference number used in the preceding figures, without their description being given in detail.

The housing 108 of the cartridge 107 comprises a cylindrical central crown wheel 31 onto which is fixed, on both sides by ratcheting, a flange 32, 33, each flange comprising one of the raceways 116, 117. The flange 33 forms the cover 119 which is offset in the axial direction with respect to the rim serving for ratcheting onto the crown wheel 31.

The flange 32 located on the driving-motor side 106 comprises a substantially truncated rim 34 the diameter of which increases in the direction of the motor 106. This rim 34 allows to assure the fixing of the housing and the cartridge 107 onto the driving motor-housing 106 by co-operation of said rim 34 with teeth 35 provided on the whole periphery of a toothed crown wheel 36 connected to the motor-housing 106.

The teeth 35 radially project with respect to the mean plane of the crown wheel, as can be seen in FIG. 7 and are regularly distributed over the whole circumference, as can be seen in FIG. 8. A space 37 separates two successive teeth. Each tooth 35 has a certain flexibility in the radial direction, viz. by bending at its root, to allow to trespass the end of the large diameter of the rim 34 and to seize the truncated surface of said rim. The slope effect created by the inclined surfaces of the teeth and the rim 34 allows to apply with an axial pressure the part of the flange 32 in front of the area of the crown wheel 36 located inside, in the radial direction, of the teeth 35.

The crown wheel 36 forms a particularly simple and advantageous cartridge holder allowing to place the cartridge with one hand, without having to impose a particular predetermined orientation of the cartridge 107 with respect to the motor-housing 106.

In the embodiment considered in FIG. 7, the driving element 105 is comprised of a shaft internally engaged between the tubular rollers 104.

FIG. 9 shows an alternative embodiment the elements of which playing roles identical or similar to those of the elements already described in connection with the FIGS. 1 through 6 are designated by reference numbers equal to the sum of 200 and the reference number used in the FIGS. 1 through 6.

The housing 208 has an internal groove 37 with a concave cross-section, oriented towards the axis of the housing, into which is housed the flexible tube 202. The rollers 209 have externally a barrel-shape 38, with a convex curvature combined with the concave curvature 37 of the groove of the housing.

The rollers 209 comprise, on both sides of the barrel-shaped area 38, a cylindrical area 39, 40 capable of rolling on the associated raceway 216, 217. The rollers 204 may comprise a cylindrical inner housing in order to allow the engagement of planetary gears similar to those shown in FIG. 1.

The housing 208 of the FIG. 9, with a concave internal profile, allows a self-centering of the tube and the rollers 209, so that it is practically no longer necessary to foresee shoulders on both sides of the rollers to maintain same in the axial direction. This results into a substantial reduction of the wear of the rollers and a longer lifetime of the cartridge. Furthermore, frictional heating is reduced. The tightness brought about by the crushing of the tube 202 between the concave surface 37 and the convex surface 38 of the roller is better, viz. in the area of the commissure. This allows to obtain higher pump delivery pressures and energy savings for a same delivery rate.

The cartridge and the pump according to the invention have numerous advantages.

There is a self-centering between the pump and the motor, without radial pressure, protecting the bearing blocks of the motor. An automatic backlash compensation occurs and the axial constraints onto the axes of the rollers are cancelled.

The operation of the pump is noiseless and its assembling is easy when manufactured in series. The low manufacturing cost and the easy assembling allow the use of disposable cartridges, viz. for medical applications.

The body of the pump has a maximum resistance to wear and tear, while the manufacturing tolerances remain easy to be sticked to with raw moulded plastic parts.

It is possible to carry out a sterilization with ethylene oxide through the ambiant circulation access in the open tube of the cartridge at rest.

A minimum of parts are moving with reduced frictions and balanced dynamical constraints providing an excellent mechanical yielding and providing the possibility of using less expensive and more reliable low-power motors. A maximum natural ventilation occurs during operation, which avoids heating.

An accuracy of the delivery rates of the pumps is obtained thanks to the possibility of further standardization in the automatic mounting of the pump body tubes into the cartridges, with rigorous sizes.

The driving disc, mounted onto the driving spindle, can easily be exchanged and has a low cost because of the elementary mechanics made of plastic material.

The tubular rollers 9, as already indicated, can be obtained at low cost by sectioning of an extruded tube, which avoids an expensive production mould.

There exists a good compatibility of operation of this pump with stepped motors or geared servo-motors.

It is possible to easily manufacture the rotary parts in high-resistance materials such as polyimides, carbon fibres, aramide fibres, intended for advanced technology applications.

The quality controls of the cartridges are easily carried out at the end of the production line, allowing a rigorous calibration of the flow rates of the cartridges.

It should be noted that, with four bevel gears, the tube 2 is closed, by crushing, at least at two places.

I claim:

1. A cartridge for a peristaltic pump, of the type using a flexible tube to pump fluid, comprising a housing having at one end thereof a generally cylindrical raceway, a chamber, said raceway extending around at least a portion of said chamber, a plurality of cylindrical rollers disposed in said chamber and positioned to engage a flexible tube disposed in said raceway, said rollers each having a longitudinal axis with the axes of said rollers extending parallel to one another, said chamber having a central opening for receiving drive means for engaging and moving each said roller about an axis extending through said central opening whereby a said roller will deform a portion of the flexible tube in said raceway as a said roller is moved relative to a portion of said raceway, said chamber having a relative dimension such that with the drive means removed from said central opening, said rollers will be moved radially inwardly toward said axis of said opening of said chamber by the flexible tube to enable rapid and complete sterilization of the flexible tube.

2. A cartridge for a peristaltic pump, of the type using a flexible tube to pump fluid, comprising a housing having at one end thereof a generally cylindrical raceway, a chamber, said raceway extending around at least a portion of said chamber, a plurality of cylindrical rollers disposed in said chamber and positioned to engage a flexible tube disposed in said raceway, each said roller being a hollow tube and freely carried in said chamber of said housing, said chamber having a central opening for receiving drive means, said drive means comprising a central roller shaft mounted on a drive disc, said drive disc including a plurality of planetary shafts each for drivingly engaging a said hollow tube, said chamber having a dimension such that when said drive means is inserted in said central opening, said roller shaft will force said hollow tubes apart and when said drive means is removed from said opening of said chamber said hollow tubes will be moved radially inwardly toward said axis of said opening by said flexible tube to enable rapid and complete sterilization of the flexible tube.

3. The cartridge as claimed in claims 1 or 2, wherein said raceway is an internal groove formed in said chamber and having a concave cross-section for receiving said flexible tube and said cylindrical rollers including a barrel shape portion for engaging said flexible hose, each said roller having opposite ends of cylindrical shape for rolling on a portion of said raceway that is spaced from said concave portion, said concave portion of said raceway facilitating self-centering of a flexible tube and said rollers.

4. A cartridge as claimed in claims 1 or 2 wherein said housing includes a cylindrical central crown wheel having spaced apart peripheral edges and an annular flange mounted on each said edge, said flanges having interior surface portions defining said cylindrical raceway, one of said flanges surrounding an opening for receiving said drive means, said drive means comprising a motor, said one flange including a peripheral, exterior recess for cooperation with a mounting means for securing connection of said housing to said motor, said mounting means comprising a plurality of teeth carried by an annular member connected to said motor.

5. The cartridge as claimed in claims 1 or 2, wherein said cylindrical rollers are tubular and made of flexible plastic material.

6. A peristaltic pump fitted with a cartridge as claimed in claims 1 or 2, wherein said pump includes a motor having an output shaft, said output shaft including a disk having a face with a plurality of spindles extending transversely from said face, each said spindle having a spindle roller carried thereon for engaging a said cylindrical roller of said cartridge, said disk including a drive spindle located to extend axially from said output shaft of said motor and having a central roller mounted on said drive spindle with a relatively large self-centering backlash.

7. The pump as claimed in claim 6, wherein said housing has a side opposite said central opening and a cover inserted on said housing to close said side, said cover having an internal face defining a portion of said raceway for said cylindrical rollers.

8. The pump as claimed in claims 6 or 7, wherein said disk supports four rollers and a central roller.

9. A peristaltic pump as claimed in claim 1, further including drive means comprising a motor having an output shaft for insertion through said central opening for engaging and moving each said roller.

* * * * *